US008668018B2

(12) United States Patent
Fay

(10) Patent No.: US 8,668,018 B2
(45) Date of Patent: Mar. 11, 2014

(54) SELECTIVE DART SYSTEM FOR ACTUATING DOWNHOLE TOOLS AND METHODS OF USING SAME

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 13/045,137

(22) Filed: Mar. 10, 2011

(65) Prior Publication Data

US 2012/0227980 A1 Sep. 13, 2012

(51) Int. Cl.
*E21B 34/08* (2006.01)

(52) U.S. Cl.
USPC ..... 166/373; 166/374; 166/135

(58) Field of Classification Search
USPC ..... 251/359
See application file for complete search history.

(56) References Cited

U.S. PATENT DOCUMENTS

| | | | | |
|---|---|---|---|---|
| 1,883,071 | A | | 10/1932 | Stone |
| 2,117,539 | A | | 5/1938 | Baker et al. |
| 2,329,242 | A | * | 9/1943 | Best ..... 4/295 |
| 2,769,454 | A | | 11/1956 | Bletcher et al. |
| 2,822,048 | A | * | 2/1958 | Tausch ..... 166/114 |
| 2,822,757 | A | | 2/1958 | Coberly |
| 2,829,719 | A | | 4/1958 | Clark, Jr. |
| 2,857,972 | A | | 10/1958 | Baker et al. |
| 2,973,006 | A | | 2/1961 | Nelson |
| 3,007,527 | A | | 11/1961 | Nelson |
| 3,013,612 | A | | 12/1961 | Angel |
| 3,043,903 | A | | 7/1962 | Keane et al. |
| 3,090,442 | A | | 5/1963 | Cochran et al. |
| 3,211,232 | A | | 10/1965 | Grimmer |
| 3,220,481 | A | | 11/1965 | Park |
| 3,220,491 | A | | 11/1965 | Mohr |
| 3,503,445 | A | * | 3/1970 | Cochrum et al. ..... 166/244.1 |
| 3,510,103 | A | | 5/1970 | Carsello |
| 3,566,964 | A | | 3/1971 | Livingston |

(Continued)

FOREIGN PATENT DOCUMENTS

| | | | |
|---|---|---|---|
| CA | 2460712 | | 4/2005 |
| EP | 0518371 | A3 | 12/1992 |
| WO | WO/02 68793 | A1 | 9/2002 |
| WO | WO 03006787 | A1 | 1/2003 |

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

(Continued)

*Primary Examiner* — Jennifer H Gay
*Assistant Examiner* — Caroline Butcher
(74) *Attorney, Agent, or Firm* — Parsons Behle & Latimer

(57) ABSTRACT

Plug element systems comprise a tubular member having at least two seats. An eccentrically-shaped plug member comprises an upper end portion and a lower end portion. The upper end portion comprises an upper end diameter can be less than, greater than, or equal to a lower end portion diameter of the lower end portion. The eccentric shape of the plug member permits it to pass through a first seat and land on a second seat comprising a second seat length where both the first seat and the second seat comprise substantially equal inner seat diameters.

17 Claims, 6 Drawing Sheets

(56) References Cited

U.S. PATENT DOCUMENTS

| | | | | |
|---|---|---|---|---|
| 3,667,505 | A | 6/1972 | Radig | |
| 3,727,635 | A | 4/1973 | Todd | |
| 3,776,258 | A | 12/1973 | Dockins, Jr. | |
| 3,901,315 | A | 8/1975 | Parker et al. | |
| 4,114,694 | A | 9/1978 | Dinning | |
| 4,160,478 | A | 7/1979 | Calhoun et al. | |
| 4,194,566 | A | 3/1980 | Maly | |
| 4,291,722 | A | 9/1981 | Churchman | |
| 4,292,988 | A | 10/1981 | Montgomery | |
| 4,311,163 | A * | 1/1982 | Langevin | 137/315.01 |
| 4,314,608 | A | 2/1982 | Richardson | |
| 4,374,543 | A | 2/1983 | Richardson | |
| 4,390,065 | A | 6/1983 | Richardson | |
| 4,448,216 | A | 5/1984 | Speegle et al. | |
| 4,478,279 | A | 10/1984 | Puntar et al. | |
| 4,510,994 | A | 4/1985 | Pringle | |
| 4,520,870 | A | 6/1985 | Pringle | |
| 4,537,255 | A | 8/1985 | Regalbuto et al. | |
| 4,537,383 | A | 8/1985 | Fredd | |
| 4,576,234 | A | 3/1986 | Upchurch | |
| 4,583,593 | A | 4/1986 | Zunkel et al. | |
| 4,669,538 | A | 6/1987 | Szarka | |
| 4,729,432 | A | 3/1988 | Helms | |
| 4,823,882 | A | 4/1989 | Stokley et al. | |
| 4,826,135 | A | 5/1989 | Mielke | |
| 4,828,037 | A | 5/1989 | Lindsey et al. | |
| 4,848,691 | A | 7/1989 | Muto et al. | |
| 4,862,966 | A | 9/1989 | Lindsey et al. | |
| 4,893,678 | A | 1/1990 | Stokley et al. | |
| 4,915,172 | A | 4/1990 | Donovan et al. | |
| 4,949,788 | A | 8/1990 | Szarka et al. | |
| 4,991,654 | A | 2/1991 | Brandell et al. | |
| 5,056,599 | A | 10/1991 | Comeaux et al. | |
| 5,146,992 | A | 9/1992 | Baugh | |
| 5,244,044 | A | 9/1993 | Henderson | |
| 5,246,203 | A | 9/1993 | McKnight et al. | |
| 5,297,580 | A | 3/1994 | Thurman | |
| 5,309,995 | A | 5/1994 | Gonzalez et al. | |
| 5,333,689 | A | 8/1994 | Jones et al. | |
| 5,335,727 | A | 8/1994 | Cornette et al. | |
| 5,413,180 | A | 5/1995 | Ross et al. | |
| 5,479,986 | A | 1/1996 | Gano et al. | |
| 5,501,276 | A | 3/1996 | Weaver et al. | |
| 5,558,153 | A | 9/1996 | Holcombe et al. | |
| 5,577,560 | A | 11/1996 | Coronado et al. | |
| 5,607,017 | A | 3/1997 | Owens et al. | |
| 5,623,993 | A | 4/1997 | Van Buskirk et al. | |
| 5,685,372 | A | 11/1997 | Gano | |
| 5,704,393 | A | 1/1998 | Connell et al. | |
| 5,709,269 | A | 1/1998 | Head | |
| 5,762,142 | A | 6/1998 | Connell et al. | |
| 5,765,641 | A | 6/1998 | Shy et al. | |
| 5,813,483 | A | 9/1998 | Latham et al. | |
| 5,960,881 | A | 10/1999 | Allamon et al. | |
| 5,992,289 | A | 11/1999 | George et al. | |
| 6,003,607 | A | 12/1999 | Hagen et al. | |
| 6,026,903 | A | 2/2000 | Shy et al. | |
| 6,050,340 | A | 4/2000 | Scott | |
| 6,053,248 | A | 4/2000 | Ross | |
| 6,053,250 | A | 4/2000 | Echols | |
| 6,062,310 | A | 5/2000 | Wesson et al. | |
| 6,076,600 | A | 6/2000 | Vick, Jr. et al. | |
| 6,079,496 | A | 6/2000 | Hirth | |
| 6,102,060 | A | 8/2000 | Howlett et al. | |
| 6,155,350 | A | 12/2000 | Melenyzer | |
| 6,161,622 | A | 12/2000 | Robb et al. | |
| 6,189,618 | B1 | 2/2001 | Beeman et al. | |
| 6,220,350 | B1 | 4/2001 | Brothers et al. | |
| 6,279,656 | B1 | 8/2001 | Sinclair et al. | |
| 6,289,991 | B1 | 9/2001 | French | |
| 6,293,517 | B1 | 9/2001 | Cunningham | |
| 6,382,234 | B1 | 5/2002 | Birckhead et al. | |
| 6,397,950 | B1 | 6/2002 | Streich et al. | |
| 6,431,276 | B1 | 8/2002 | Robb et al. | |
| 6,457,517 | B1 | 10/2002 | Goodson et al. | |
| 6,467,546 | B2 | 10/2002 | Allamon et al. | |
| 6,530,574 | B1 | 3/2003 | Bailey et al. | |
| 6,547,007 | B2 | 4/2003 | Szarka et al. | |
| 6,634,428 | B2 | 10/2003 | Krauss et al. | |
| 6,666,273 | B2 | 12/2003 | Laurel | |
| 6,668,933 | B2 | 12/2003 | Kent | |
| 6,708,946 | B1 | 3/2004 | Edwards et al. | |
| 6,779,600 | B2 | 8/2004 | King et al. | |
| 6,834,726 | B2 | 12/2004 | Giroux et al. | |
| 6,848,511 | B1 | 2/2005 | Jones et al. | |
| 6,866,100 | B2 | 3/2005 | Gudmestad et al. | |
| 6,896,049 | B2 | 5/2005 | Moyes | |
| 6,926,086 | B2 | 8/2005 | Patterson et al. | |
| 6,966,368 | B2 | 11/2005 | Farquhar | |
| 7,021,389 | B2 | 4/2006 | Bishop et al. | |
| 7,093,664 | B2 | 8/2006 | Todd et al. | |
| 7,150,326 | B2 | 12/2006 | Bishop et al. | |
| 7,311,118 | B2 | 12/2007 | Doutt | |
| 7,325,617 | B2 | 2/2008 | Murray | |
| 7,350,582 | B2 | 4/2008 | McKeachnie et al. | |
| 7,353,879 | B2 | 4/2008 | Todd et al. | |
| 7,395,856 | B2 | 7/2008 | Murray | |
| 7,416,029 | B2 | 8/2008 | Telfer et al. | |
| 7,464,764 | B2 | 12/2008 | Xu | |
| 7,469,744 | B2 | 12/2008 | Ruddock et al. | |
| 7,503,392 | B2 | 3/2009 | King et al. | |
| 7,625,846 | B2 | 12/2009 | Cooke, Jr. | |
| 7,628,210 | B2 | 12/2009 | Avant et al. | |
| 7,640,991 | B2 | 1/2010 | Leising | |
| 7,644,772 | B2 | 1/2010 | Avant et al. | |
| 2002/0162661 | A1 | 11/2002 | Krauss et al. | |
| 2003/0037921 | A1 | 2/2003 | Goodson | |
| 2003/0141064 | A1 | 7/2003 | Roberson, Jr. | |
| 2003/0168214 | A1 | 9/2003 | Sollesnes | |
| 2004/0108109 | A1 | 6/2004 | Allamon et al. | |
| 2005/0061372 | A1 | 3/2005 | McGrath et al. | |
| 2005/0092363 | A1 | 5/2005 | Richard et al. | |
| 2005/0092484 | A1 | 5/2005 | Evans | |
| 2005/0126638 | A1 | 6/2005 | Gilbert | |
| 2005/0161224 | A1 | 7/2005 | Starr et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2005/0281968 | A1 | 12/2005 | Shanholtz et al. | |
| 2006/0021748 | A1 | 2/2006 | Swor et al. | |
| 2006/0131031 | A1 | 6/2006 | McKeachnie et al. | |
| 2006/0175092 | A1 | 8/2006 | Mashburn | |
| 2006/0213670 | A1 | 9/2006 | Bishop et al. | |
| 2006/0243455 | A1 | 11/2006 | Telfer et al. | |
| 2006/0266518 | A1 | 11/2006 | Woloson | |
| 2007/0023087 | A1 | 2/2007 | Krebs et al. | |
| 2007/0029080 | A1 | 2/2007 | Moyes | |
| 2007/0062706 | A1 | 3/2007 | Leising | |
| 2007/0074873 | A1 | 4/2007 | McKeachnie et al. | |
| 2007/0169935 | A1 | 7/2007 | Akbar et al. | |
| 2007/0295507 | A1 | 12/2007 | Telfer | |
| 2008/0017375 | A1 | 1/2008 | Wardley | |
| 2008/0066923 | A1 | 3/2008 | Xu | |
| 2008/0066924 | A1 | 3/2008 | Xu | |
| 2008/0217025 | A1 | 9/2008 | Ruddock et al. | |
| 2009/0025927 | A1 | 1/2009 | Telfer | |
| 2009/0044946 | A1 | 2/2009 | Schasteen et al. | |
| 2009/0044948 | A1 | 2/2009 | Avant et al. | |
| 2009/0044949 | A1 | 2/2009 | King et al. | |
| 2009/0044955 | A1 | 2/2009 | King et al. | |
| 2009/0107684 | A1 | 4/2009 | Cooke, Jr. | |
| 2010/0032151 | A1 | 2/2010 | Duphorne | |
| 2010/0132954 | A1 | 6/2010 | Telfer | |
| 2010/0252280 | A1 * | 10/2010 | Swor et al. | 166/386 |
| 2011/0187062 | A1 | 8/2011 | Xu | |
| 2011/0315390 | A1 | 12/2011 | Guillory et al. | |
| 2012/0012771 | A1 | 1/2012 | Korkmaz et al. | |
| 2012/0048556 | A1 | 3/2012 | O'Connell et al. | |

(56) References Cited

U.S. PATENT DOCUMENTS

| | | | |
|---|---|---|---|
| 2012/0199341 | A1 | 8/2012 | Kellner et al. |
| 2012/0261115 | A1 | 10/2012 | Xu |

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

Baker Hughes Incorporated. Model "E" Hydro-Trip Pressure Sub, Product Family No. H79928, Sep. 25, 2003, pp. 1-4, Baker Hughes Incorporated, Houston, Texas USA.

Innicor Completion Systems, HydroTrip Plug Sub, Product No. 658-0000, Jul. 26, 2004, p. 1, Innicor Completion Systems, Canada.

K.L. Smith, et al., "Ultra-Deepwater Production Systems Technical Progress Report," U.S. Department of Energy, Science and Technical Information, Annual Technical Progress Report, Jan. 2005, pp. 1-32, ConocoPhillips Company, U.S.A.

X. Li, et al., An Integrated Transport Model for BallSealer Diversion in Vertical and Horizontal Wells, Oct. 9, 2005, pp. 1-9, SPE 96339, Society of Petroleum Engineers, U.S.A.

G.L. Rytlewski, A Study of Fracture Initiation Pressures in Cemented Cased Hole Wells Without Perforations, May 15, 2006, pp. 1-10, SPE 100572, Society of Petroleum Engineers, U.S.A.

StageFRAC Maximize Reservoir Drainage, 2007, pp. 1-2, Schlumberger, U.S.A.

Brad Musgrove, Multi-Layer Fracturing Solution Treat and Produce Completions, Nov. 12, 2007, pp. 1-23, Schlumberger, U.S.A.

* cited by examiner

SELECTIVE DART SYSTEM FOR ACTUATING DOWNHOLE TOOLS AND METHODS OF USING SAME

BACKGROUND

1. Field of Invention

The present invention is directed to an eccentrically-shaped plug members for use with seats disposed within a tubular member for restricting fluid flow through tubulars disposed within oil and gas wells and, in particular, to eccentrically-shaped plug members that permit a consistent inner diameter through two or more seats.

2. Description of Art

Seats disposed within oil and gas wellbores for landing a plug member to restrict flow through the wellbore are generally known in the art. For example, typical seats are disposed on a tubular member have a bore or passageway that is restricted by the seat. The plug element, such as a ball or dart, is disposed on the seat, preventing or restricting fluid from flowing through the bore of the seat and, thus, isolating the tubing or conduit section in which the seat is disposed. As force is applied to the plug member, the conduit can be pressurized for tubing testing or tool actuation or manipulation, such as in setting a packer. Seats are also used in cased hole completions, liner hangers, flow diverters, frac systems, and flow control equipment and systems.

In a tubular having multiple seats, the inner diameter opening through the seat decreases in size as the seat is located lower down the tubular. For example, in a tubular having three seats, the lowermost seat comprises an inner diameter that is smaller than the inner diameter of the seat located above the lowermost seat. Similarly, the uppermost seat has an inner diameter that is larger than the inner diameters of the seats located below the uppermost seat. This variation in the inner diameters is so that a plug element can pass through the seat(s) above to land on the seat below.

SUMMARY OF INVENTION

Broadly, plug elements having eccentric shapes are disclosed herein. The eccentrically-shaped plug elements can be used in tools having two or more seats where each seat has an inner diameter opening that is substantially equal to the other seats. As a result, the tool has a substantially constant diameter through the tool for the passage of additional tools string or flowing of fluids through the tool. In one embodiment of the plug elements disclosed herein, the plug member comprises an upper end having a seat engagement profile, the upper end comprising a upper end diameter and a lower end comprising a lower end diameter, the upper end diameter being less than the lower end diameter.

In one broad embodiment of a tool using one or more eccentrically-shaped plug element, the tool comprises a tubular member having an upper seat and a lower seat. Upon being disposed at the desired location within a well, an eccentrically-shaped plug element is dropped down the bore of the tubular member where is it engages the upper seat. Due to the shape of the eccentrically-shaped dart, however, the eccentrically-shaped dart does not remain on the upper seat, but instead is allowed to pass through the upper seat. As a result, the eccentrically-shaped dart lands on the lower seat to block fluid flow through the tubular member. Pressure is then increased above the lower seat causing a downhole operation to be performed such as actuation of the tool itself or actuation of another downhole tool disposed above the lower seat. Due to the eccentric shape of the dart, the inner diameter of the upper seat and the lower seat can be the same as opposed to having the inner diameter of the lower seat being smaller than the inner diameter of the upper seat. In other words, the maximum inner diameter through the tool can be essentially constant.

Thereafter, a second plug member, such as another eccentrically-shaped plug, a ball, or other plug member can be dropped down the tubular member to land on the upper seat to block fluid flow through the tubular member. Pressure is then increased above the upper seat causing a second actuation of the tool itself, or actuation of another downhole tool disposed above the upper seat.

Additional seats may be disposed below the lower seat so that additional actuations can be performed by the tool. In such an arrangement, two or more eccentrically-shaped plug members can be dropped down the tubular member until they engage their corresponding seats.

Figure 1:
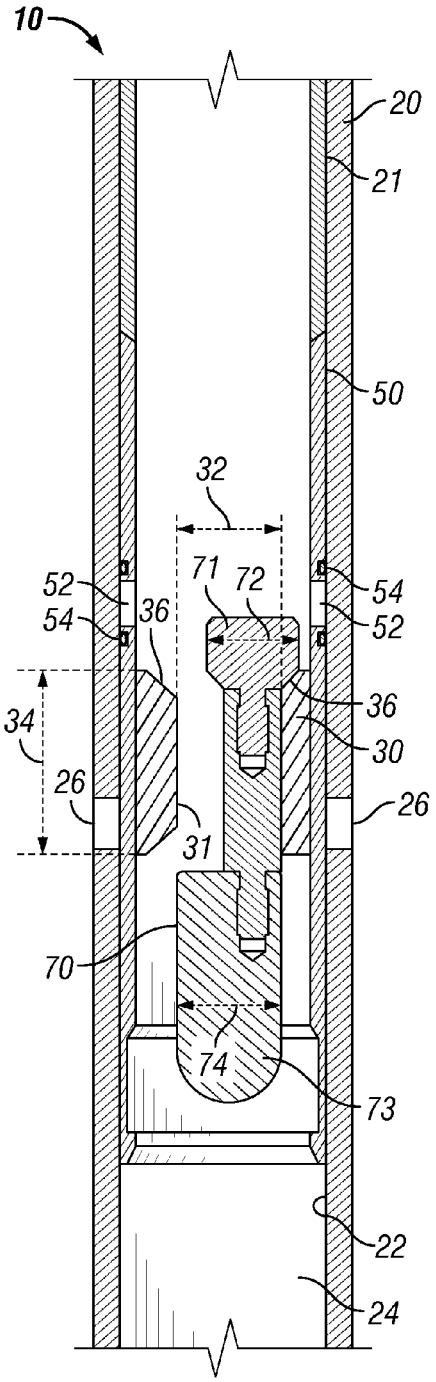
FIG. 1 is a cross-sectional view of a specific embodiment of a tool disclosed herein showing a first seat having landed thereon a first plug element.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-5, in one embodiment, downhole tool 10 comprises tubular member 20 comprising first or upper seat 30 and second or lower seat 40. As shown in this particular embodiment, first seat 30 is operatively associated with upper or first or upper sleeve 50 and second seat 40 is operatively associated with second or lower sleeve 60.

First seat 30 comprises inner diameter 32, length 34, and seat engagement profile 36. Seat engagement profile 36 is shown as a bevel, however, it can have any shape desired or necessary for receiving a plug member.

Second seat 40 comprises inner diameter 42, length 44, and seat engagement profile 46. Seat engagement profile 46 is shown as a bevel, however, it can have any shape desired or necessary for receiving a plug member. Second seat inner diameter 42 is substantially equal to first set inner diameter 32 such that the passage through tool 10 has an essentially constant maximum inner diameter for the passage of additional tools or fluid, including production of hydrocarbons from a well. In the embodiment of FIGS. 1-5, second seat 40 length 44 is longer than first seat 30 length 34 to facilitate a first plug member (discussed in greater detail below) passing through first seat 30 and land on second seat 40 to restrict fluid flow through second seat 40 so that a downhole operation, such as actuation of a downhole tool, can be performed. Thus, although the initial landing of the first plug member on first seat 30 technically "restricts" fluid flow through first seat 30, because the first plug member ultimately passes through first seat 30, no downhole operation is performed and, thus, it does not "restrict," as this term is used in this herein, fluid flow through first seat 30.

In the specific embodiment of FIGS. 1-5, tubular member 20 comprises inner wall surface 22 defining bore 24 with first tubular member ports 26 and second tubular member ports 28. First sleeve 50 comprises first sleeve ports 52 having seals 54 disposed above and below first sleeve ports 52. First sleeve ports 52 initially are out of alignment with first tubular member ports 26. Second sleeve 60 comprises first sleeve ports 62 having seals 64 disposed above and below first sleeve ports 62. First sleeve ports 62 initially are out of alignment with first tubular member ports 28.

Although not required, tubular member 20 is shown in the embodiment of FIGS. 1-5 as having inner liners 21, 23 disposed above first and second sleeves 50, 60 respectively, to prevent downward flowing fluid from prematurely moving sleeves 50, 60.

Figure 2:
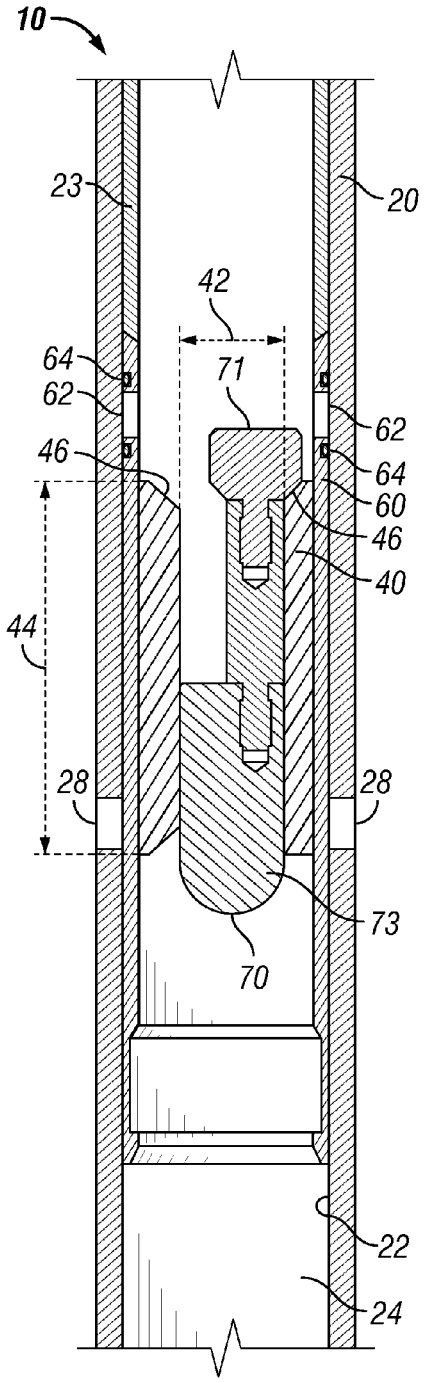
FIG. 2 is a cross-sectional view of the tool of FIG. 1 showing a second seat having landed thereon the first plug element of FIG. 1.
Figure 3:
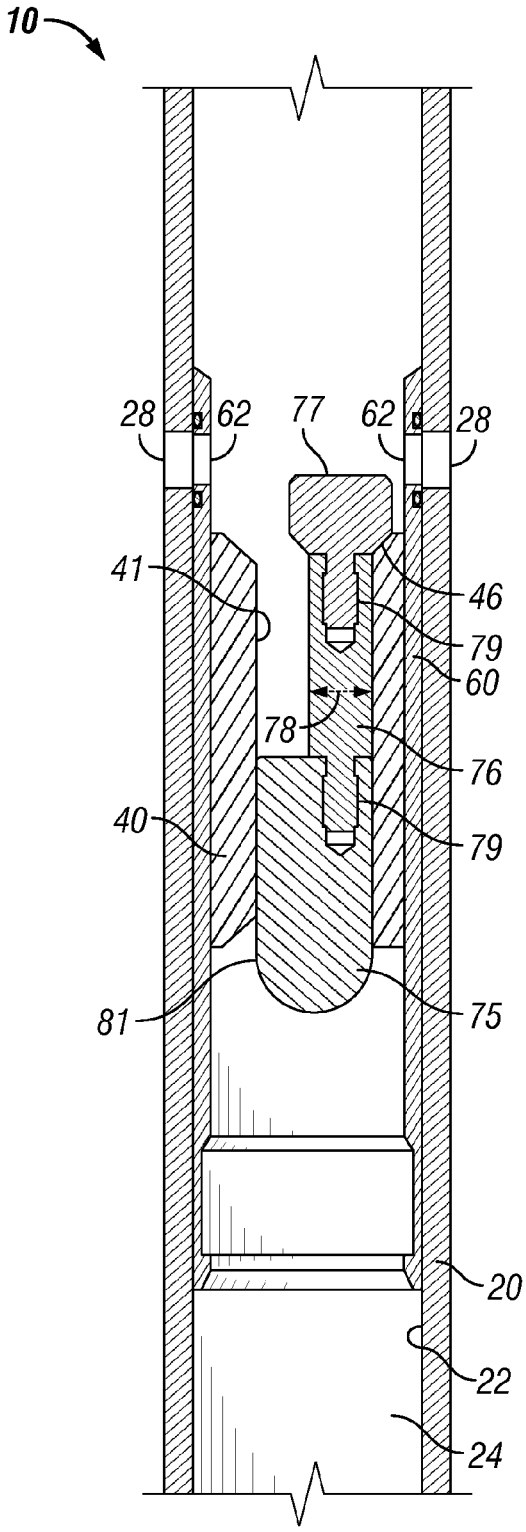
FIG. 3 is a cross-sectional view of the tool of FIG. 1 showing the second seat having been moved downward after the landing of the first plug element of FIG. 1 on the second seat.

Referring to FIGS. 1-3, first plug member 70 comprises upper end portion or upper end 71 having upper end portion outer diameter 72 and lower end portion or lower end 73 having lower end portion diameter 74. To facilitate passing first plug element 70 through one or more seat for landing on a lower seat, in the embodiment of FIGS. 1-5, upper end portion diameter 72 is less than lower end portion diameter 74. It is to be understood however, that in other embodiments, upper end portion diameter 72 may be greater than or equal to lower end portion diameter 74.

As shown in FIG. 3, first plug member 70 of this embodiment is shown as comprising three elements 75, 76, 77 releasably secured to each other through fasteners such as threads 79. First element 75 comprises lower end 71 and is releasably secured to second element 76. Second element 76 is then releasably secured to third element 77 which comprises upper end 71. Thus, first element 75 comprises lower end diameter 74 and third element 77 comprises upper end diameter 72. Second element 76 comprises intermediate or second element diameter 78. As shown in FIGS. 1-3, intermediate diameter 78 is smaller than upper end diameter 72 and lower end diameter 74; however, intermediate diameter 78 is not required to be smaller than upper end diameter 72. In addition, in embodiments, not shown, second element 76 may be concentrically disposed relative to first element 75.

Although not shown, one or more additional elements may be disposed between first and third elements 75, 77 so that the overall length of first plug element 70 can be modified for passing through one or more seats to land on a particular seat having an appropriate seat length for landing the plug member and restricting fluid flow through the seat.

The eccentric shape of first plug member 70 permits first plug member 70 to pass through first seat 30 and land and restrict flow through second seat 40. As shown in FIG. 1, first plug member 70 is initially landed on first seat 30, however, fluid flow is permitted to continue to pass through first seat 30 due to the eccentric shape of first plug member 70. As a result, in the embodiment of FIGS. 1-5, first plug member 70 is ultimately moved off of first seat engagement profile 36 so that it passes through first seat 30. Thereafter, first plug member 70 lands on second seat 40. Due to the increased length 44 of second seat 40 in the embodiment of FIGS. 1-5, upper end 71 of first plug member 70 engages with second seat engagement profile 46 while outer wall surface 81 of lower end 73 of first plug member 70 engages with inner wall surface 41 of second seat 40. As a result, fluid flow is restricted through second seat 40 so that a downhole operation, such as actuation of a tool disposed above second seat or, as discussed below, movement of second sleeve 60 to align second sleeve ports 62 with second tubular member ports 28.

Figure 4:
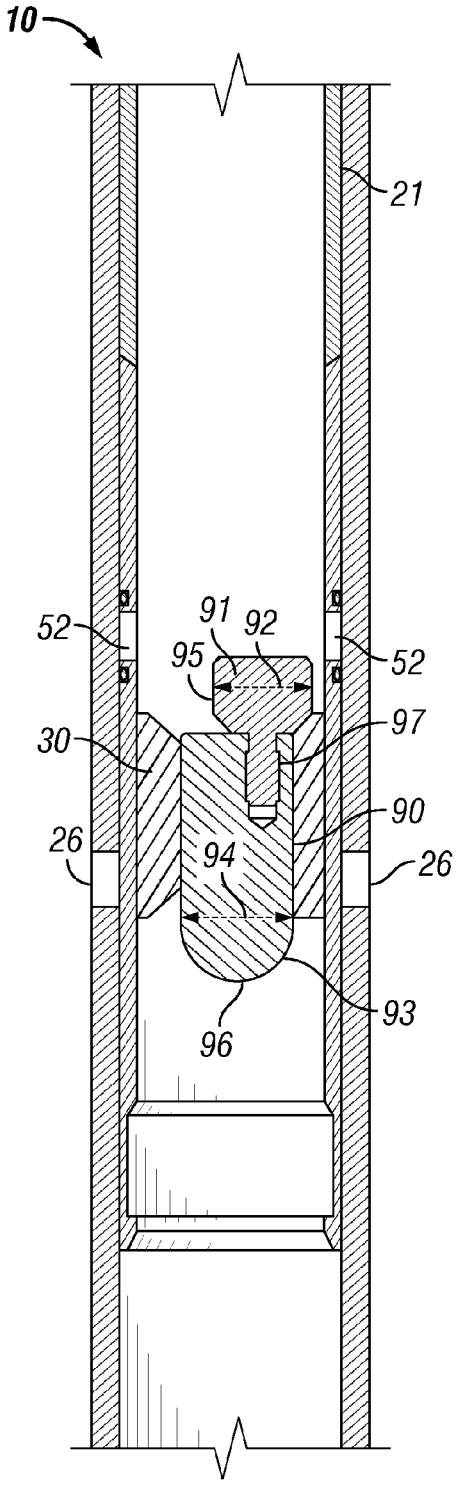
FIG. 4 is a cross-sectional view of the tool of FIG. 1 showing the first seat having landed thereon a second plug element.
Figure 5:
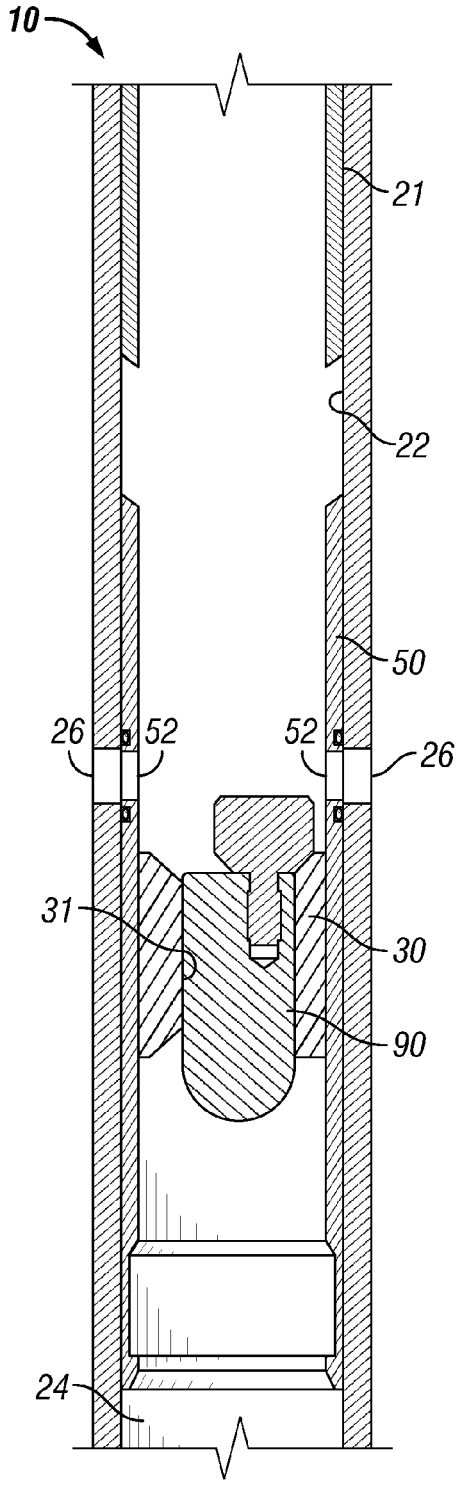
FIG. 5 is a cross-sectional view of the tool of FIG. 1 showing the first seat having been moved downward after the landing of the second plug element of FIG. 4 on the first seat.

Referring now to FIGS. 4 and 5, second plug element comprises 90 upper end 91 having upper end diameter 92 and lower end 93 having lower end diameter 94. Lower end diameter 94 is substantially equal to first seat inner diameter 32 and is greater than upper end diameter 92 of upper end 91. However, as discussed above with respect to first plug element 70, upper end diameter 92 can be greater than, or equal to, lower end diameter 94. Upper end 91 is disposed on first element 95 and lower end 93 is disposed on second element 96. First element 95 is secured to second element 96 by threads 97.

As shown in the embodiment of FIGS. 1-5, second plug member 90 comprises an eccentric-shape; however, it is to be understood that when the second plug member comprises the plug member for restricting fluid flow through the uppermost seat, the second plug member can be any plug member known in the art, including, but not limited to, a ball.

In operation, a tool having at least two seats, such as tool 10, is lowered into a wellbore, either cased or open-holed (not shown). Upon reaching the desired location within the wellbore, a first eccentrically-shaped plug element, e.g., first plug element 70, is dropped down the tool string until it reaches first seat 30. Lower end 73 of first plug element 70 is guided into inner diameter 32 of first seat 30 by seat engagement profile 36. Fluid pressure from above pushes lower end 73 of first plug member 70 into and through inner diameter 32 of first seat 30 until a seat engagement profile disposed on upper end 71 of first plug member 70 engages seat engagement profile 36 such as shown in FIG. 1. Continued fluid pressure from above flows through first seat 30 due to the eccentric shape of first plug element 70 and because lower end 73 is no longer engaged with inner wall surface 31 of first seat 30. This continued fluid pressure ultimately moves upper end 71 of first plug member off of seat engagement profile 36 so that first plug element 70 falls through inner diameter 32 of first seat 30.

First plug element 70 falls within tool 10 until it reaches second seat 40. Lower end 73 of first plug element 70 is guided into inner diameter 42 of second seat 40 by seat engagement profile 46. Fluid pressure from above pushes lower end 73 of first plug member 70 along inner wall surface 41 of second seat 40 and, thus, into inner diameter 42, until a seat engagement profile disposed on upper end 71 of first plug member 70 engages seat engagement profile 46 such as shown in FIG. 2. Upon this engagement, lower end 73 of first plug member 70 remains in contact with inner wall surface 41 of second seat 40 and, therefore, restricts fluid flow through second seat 40 so that a downhole operation can be performed.

In the embodiment of FIGS. 1-5, a first downhole operation performed by first plug member 70 landing on second seat 40 and restricting fluid flow through second seat 40 is the alignment of second sleeve ports 62 with second tubular member ports 28. Fluid pressure above second seat 40 forces second seat 40 and, thus, second sleeve 60 downward from the position shown in FIG. 2 until second sleeve ports 62 are aligned with second tubular member ports 28 as shown in FIG. 3. Thereafter, fluid such as fracturing fluid, acid treatment, and the like can be pumped down bore 24 of tubular member and out of tool 10 through second sleeve ports 62 and second tubular member ports 28. Alternatively, fluid from outside tool 10 can flow through second sleeve ports 62 and second tubular member ports 28 and into bore 24 of tubular member 20. Alternatively, in embodiments in which second sleeve 40 is absent, the increased pressure above second seat 40 can actuate another downhole tool disposed above second seat 40.

Thereafter, a second plug member can be dropped down the tool string until it reaches first seat 30 where the second plug member engages seat engagement profile 36 and fluid flow through first seat 30 is restricted. Although the second plug member can be any plug member known in the art if the first seat 30 is the uppermost seat of tool 10, in the embodiment of FIGS. 1-5, the second plug member is an eccentrically shaped plug member.

Lower end 93 of second plug element 90 is guided into inner diameter 32 of first seat 30 by seat engagement profile 36. Fluid pressure from above pushes lower end 93 of second plug member 90 along inner wall surface 31 of first seat 30 and, thus, into inner diameter 32, until a seat engagement profile disposed on upper end 91 of second plug member 90 engages seat engagement profile 36 such as shown in FIG. 4. Upon this engagement, lower end 93 of first plug member 90 remains in contact with inner wall surface 31 of first seat 30 and, therefore, restricts fluid flow through first seat 30 so that another downhole operation can be performed.

In the embodiment of FIGS. 1-5, the second downhole operation performed by second plug member 90 landing on first seat 30 and restricting fluid flow through first seat 30 is the alignment of first sleeve ports 52 with first tubular member ports 26. Fluid pressure above first seat 30 forces first seat 30 and, thus, first sleeve 50 downward from the position shown in FIG. 4 until first sleeve ports 52 are aligned with first tubular member ports 26 as shown in FIG. 5. Thereafter, fluid such as fracturing fluid, acid treatment, and the like can be pumped down bore 24 of tubular member and out of tool 10 through first sleeve ports 52 and first tubular member ports 26. Alternatively, fluid from outside tool 10 can flow through first sleeve ports 52 and first tubular member ports 26 and into bore 24 of tubular member 20. Alternatively, in embodiments in which first sleeve 30 is absent, the increased pressure above first seat 30 can actuate another downhole tool disposed above first seat 30.

The foregoing procedure can be repeated based on the number of seats disposed within tool 10 or within a tool string (not shown). As discussed above, due to the eccentric-shape of the plug elements that are disposed on the seat(s) located below the uppermost seat, all of the seats can have essentially the same inner diameter so that a substantially constant opening through the tool is provided for running additional tools, or flowing fluids, through the tool.

Referring now to FIGS. 6-11, in another embodiment, downhole tool 110 comprises tubular member 120 comprising first or upper seat 130 and second or lower seat 140. As shown in this particular embodiment, first seat 130 is operatively associated with upper or first or upper sleeve 150 and second seat 140 is operatively associated with second or lower sleeve 160.

First seat 130 comprises an inner diameter a length, and seat engagement profile 136. Seat engagement profile 136 is shown as a bevel, however, it can have any shape desired or necessary for receiving a plug member.

Second seat 140 comprises an inner diameter, a length, and seat engagement profile 146. The inner diameter and length of second seat 140 are substantially equal to inner diameter and length, respectively, of first seat 130. Further, seat engagement profile 146 is shown as a bevel, however, it can have any shape desired or necessary for receiving a plug member.

In the specific embodiment of FIGS. 6-11, tubular member 120 comprises inner wall surface 122 defining bore 124 with first tubular member ports 126 and second tubular member ports 128. First sleeve 150 comprises first sleeve ports 152 having seals disposed above and below first sleeve ports 152. First sleeve ports 152 initially are out of alignment with first tubular member ports 126. Second sleeve 160 comprises first sleeve ports 162 having seals disposed above and below first sleeve ports 162. First sleeve ports 162 initially are out of alignment with first tubular member ports 128.

Figure 6:
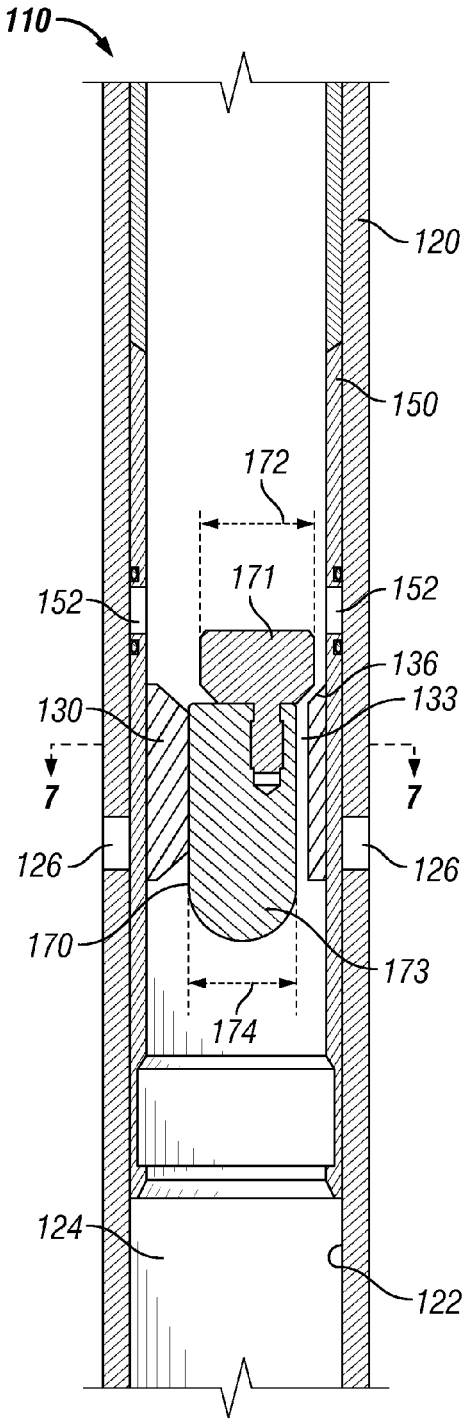
FIG. 6 is a cross-sectional view of an embodiment of a tool disclosed herein showing a first seat having landed thereon a first plug element.
Figure 9:
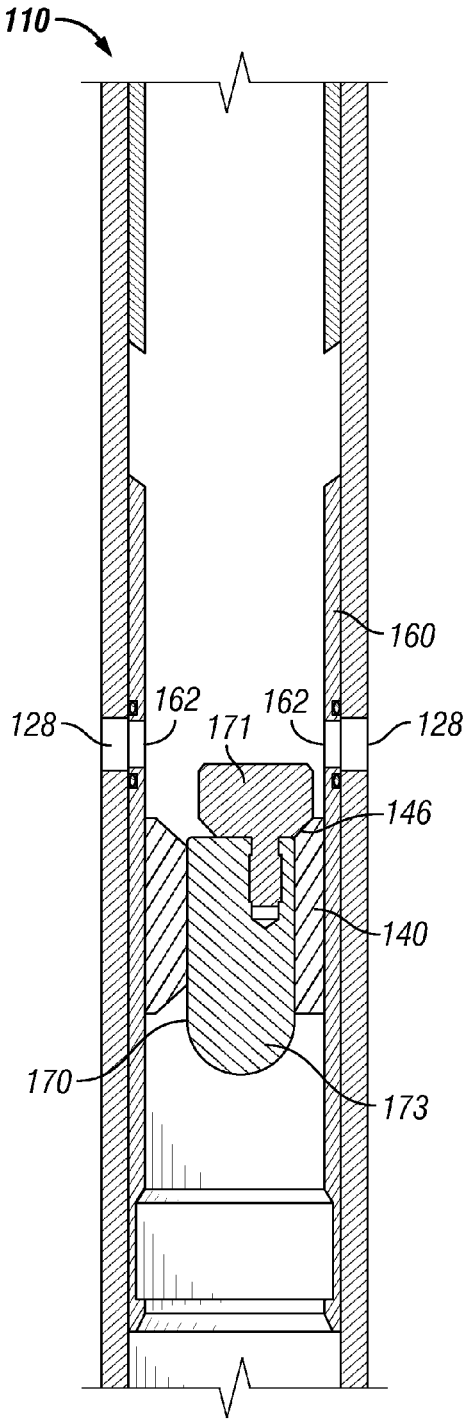
FIG. 9 is cross-sectional view of the tool of FIG. 6 showing a second seat having landed thereon the first plug element of FIG. 6.
Figure 7:
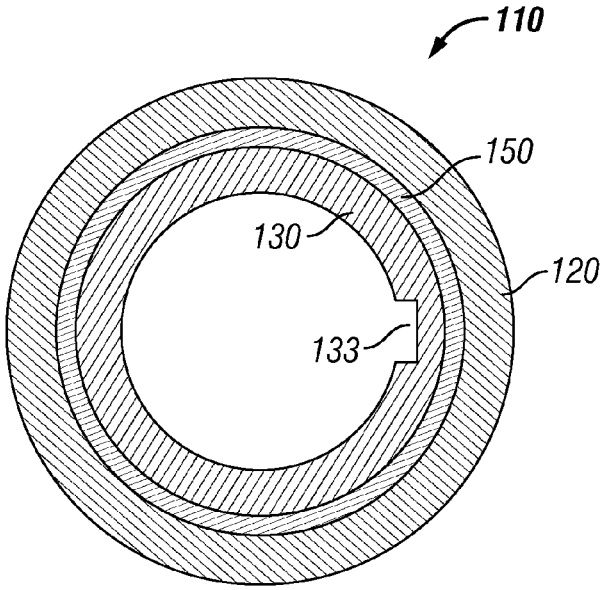
FIG. 7 is a cross-sectional top view of an embodiment of a seat operatively associated with a sleeve within a tubular member.
Figure 8:
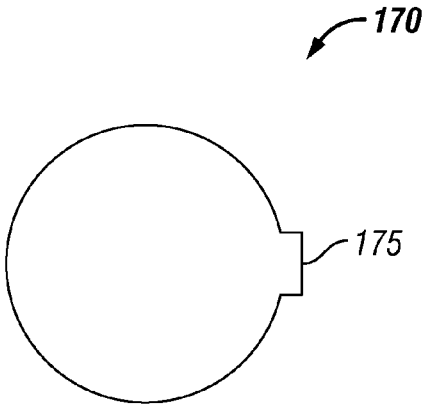
FIG. 8 is a top view of an embodiment of an embodiment of a plug element.

Referring to FIGS. 6, 8, and 9, first plug member 170 comprises upper end portion or upper end 171 having upper end portion outer diameter 172 and lower end portion or lower end 173 having lower end portion diameter 174. To facilitate passing first plug element 70 through one or more seat for landing on a lower seat, in the embodiment of FIGS. 6-11, upper end portion diameter 172 is equal to lower end portion diameter 74, however, upper end portion 171 is disposed eccentrically with lower end portion 173 due to fin 175 (FIG. 8).

The eccentric shape of first plug member 170 permits first plug member 170 to pass through first seat 130 through the alignment of fin 175 with slot 133 disposed within the inner wall surface of 130 so that first plug member 170 can land and restrict flow through second seat 140 (FIG. 9). Due to the lack of a slot in second seat 140 upper end 171 of first plug member 170 engages with second seat engagement profile 146 while the outer wall surface lower end 173 of first plug member 170 engages with the inner wall surface second seat 140. As a result, fluid flow is restricted through second seat 140 so that a downhole operation, such as actuation of a tool disposed above second seat or movement of second sleeve 160 to align second sleeve ports 162 with second tubular member ports 128.

Figure 10:
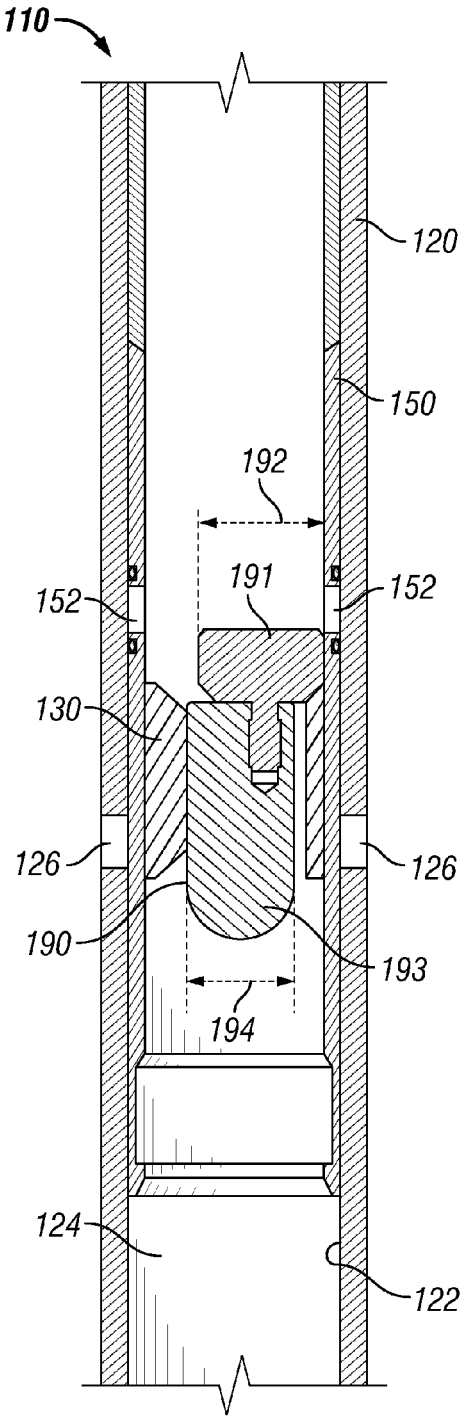
FIG. 10 is a cross-sectional view of the tool of FIG. 6 showing the first seat having landed thereon a second plug element.
Figure 11:
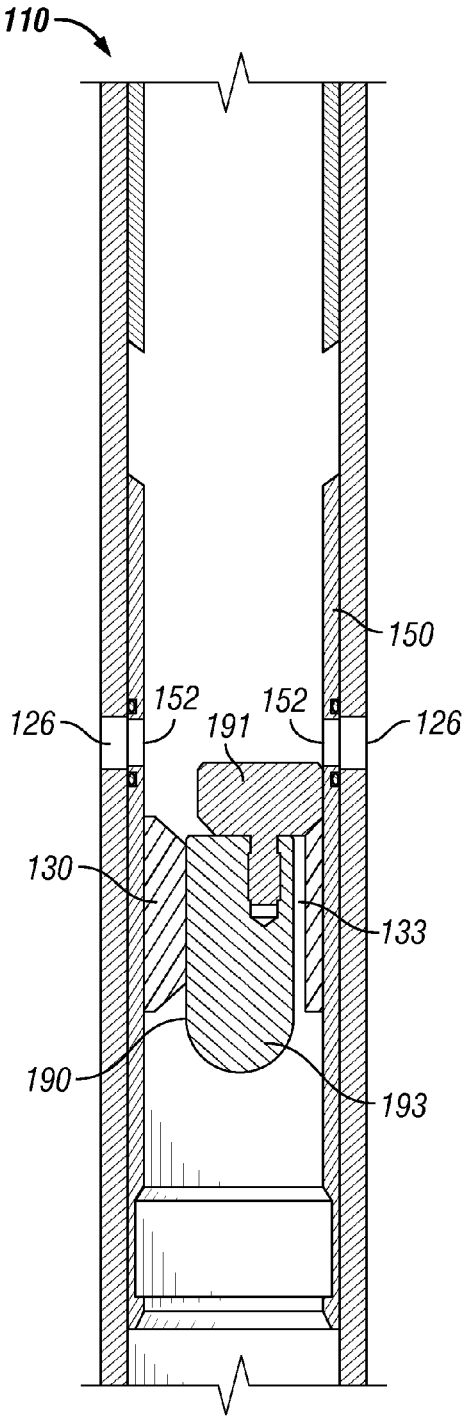
FIG. 11 is a cross-sectional view of the tool of FIG. 6 showing the first seat having been moved downward after the landing of the second plug element of FIG. 10 on the first seat.

Referring now to FIGS. 10 and 11, second plug element comprises 190 upper end 191 having upper end diameter 192 and lower end 193 having lower end diameter 194. Lower end diameter 194 is substantially equal to the first seat inner diameter, but is less than upper end diameter 192 of upper end 191. As shown in the embodiment of FIGS. 6-11, second plug member 190 comprises an eccentric-shape; however, it is to be understood that when the second plug member comprises the plug member for restricting fluid flow through the uppermost seat, the second plug member can be any plug member known in the art, including, but not limited to, a ball.

In operation, a tool having at least two seats, such as tool 110, is lowered into a wellbore, either cased or open-holed (not shown). Upon reaching the desired location within the wellbore, a first eccentrically-shaped plug element, e.g., first plug element 170, is dropped down the tool string until it reaches first seat 130. Lower end 173 of first plug element 170 is guided into the inner diameter of first seat 130 and fin 175 is guided into slot 133 by fluid flowing around upper end 171. Fluid pressure from above pushes lower end 173 of first plug member 170 into and through the inner diameter of first seat 130 and fin 175 into and through slot 133 so that first plug element 170 falls through the inner diameter of first seat 130.

First plug element 170 falls within tool 110 until it reaches second seat 140. Lower end 173 of first plug element 170 is guided into the inner diameter of second seat 140 by seat engagement profile 146. Fluid pressure from above pushes lower end 173 of first plug member 170 along the inner wall surface of second seat 140 and, thus, into inner diameter 142, until a seat engagement profile disposed on upper end 171 of first plug member 170 engages seat engagement profile 146 such as shown in FIG. 9. Upon this engagement, lower end 173 of first plug member 170 remains in contact with the inner wall surface of second seat 140 and, therefore, restricts fluid flow through second seat 140 so that a downhole operation can be performed.

In the embodiment of FIGS. 6-11, a first downhole operation performed by first plug member 170 landing on second seat 140 and restricting fluid flow through second seat 140 is the alignment of second sleeve ports 162 with second tubular member ports 128 (FIG. 9). Fluid pressure above second seat 140 forces second seat 140 and, thus, second sleeve 160 downward from an initial position until second sleeve ports 162 are aligned with second tubular member ports 128 as shown in FIG. 9. Thereafter, fluid such as fracturing fluid, acid treatment, and the like can be pumped down bore 124 of tubular member and out of tool 110 through second sleeve ports 162 and second tubular member ports 128. Alternatively, fluid from outside tool 110 can flow through second sleeve ports 162 and second tubular member ports 128 and into bore 124 of tubular member 120. Alternatively, in embodiments in which second sleeve 140 is absent, the increased pressure above second seat 140 can actuate another downhole tool disposed above second seat 140.

Thereafter, a second plug member can be dropped down the tool string until it reaches first seat 130 where the second plug member engages seat engagement profile 136 and fluid flow through first seat 130 is restricted. Although the second plug member can be any plug member known in the art if the first seat 130 is the uppermost seat of tool 110, in the embodiment of FIGS. 6-11, the second plug member 190 is an eccentrically shaped plug member (FIGS. 10-11) in which lower end diameter 194 is less than upper end diameter 192 so that upper end 191 blocks slot 133. Fluid pressure from above pushes lower end 193 of second plug member 190 along the inner wall surface of first seat 130 and, thus, into the inner diameter, until a seat engagement profile disposed on upper end 191 of second plug member 190 engages seat engagement profile 136 such as shown in FIG. 10. Upon this engagement, lower end 193 of first plug member 190 remains in contact with the inner wall surface of first seat 130 and slot 133 is blocked so that fluid flow through first seat 130 restricted allowing another downhole operation to be performed.

In the embodiment of FIGS. 6-11, the second downhole operation performed by second plug member 190 landing on first seat 130 and restricting fluid flow through first seat 130 is the alignment of first sleeve ports 152 with first tubular member ports 126. Fluid pressure above first seat 130 forces first seat 130 and, thus, first sleeve 150 downward from the position shown in FIG. 10 until first sleeve ports 152 are aligned with first tubular member ports 126 as shown in FIG. 11. Thereafter, fluid such as fracturing fluid, acid treatment, and the like can be pumped down bore 124 of tubular member and out of tool 110 through first sleeve ports 152 and first tubular member ports 126. Alternatively, fluid from outside tool 110 can flow through first sleeve ports 152 and first tubular member ports 126 and into bore 124 of tubular member 120. Alternatively, in embodiments in which first sleeve 130 is absent, the increased pressure above first seat 130 can actuate another downhole tool disposed above first seat 130.

The foregoing procedure can be repeated based on the number of seats disposed within tool 110 or within a tool string (not shown). As discussed above, due to the eccentric-shape of the plug elements that are disposed on the seat(s) located below the uppermost seat, all of the seats can have essentially the same inner diameter so that a substantially constant opening through the tool is provided for running additional tools, or flowing fluids, through the tool.

It is to be understood that the invention is not limited to the exact details of construction, operation, exact materials, or embodiments shown and described, as modifications and equivalents will be apparent to one skilled in the art. For example, although the embodiment of FIGS. 1-5 is shown as having two seats, it is to be understood that the tool may comprise three or more seats designed to permit multiple eccentric shaped plug members to pass through the appropriate number of seats to land on the seat designed to receive each plug member. Further, the seat lengths, plug member upper and lower diameters, and seat diameters can be modified as necessary to facilitate downhole operations and to permit restriction of fluid flow through each seat with a plug member. In addition, the plug member that is landed on the uppermost seat is not required to be eccentrically-shaped. Instead, it can be a ball or other traditionally shaped plug member because it is not required to be passed through the uppermost seat. Moreover, "substantially equal" when referred to the diameters and inner seat diameters means that the distances are within a certain degree of each other such that fluid can be sufficiently restricted such that sufficient fluid pressure can build above the plug member to either actuate the tool itself or another downhole tool when the lower end is engaged with the inner wall surface of a seat and the seat engagement profile 36 or 46 is engaged with the seat engagement profile disposed on the upper end of the plug member. Additionally, the seats are not required to be placed on sleeves or to align ports within the tool. Instead, the seats may be disposed directly on the inner wall surface of the tubular member thereby restricting flow through the seat to cause actuation of a tool disposed above the seat. Further, in embodiments in which one or more sleeves is present, the sleeve ports may be aligned moved into alignment with, or moved out of alignment with, respective ports disposed in the tubular member. For example, the tool can be initially configured so that the ports are aligned so that fluid can flow through the bore of the tubular member and out of the tool through the sleeve ports and the tubular member ports. Thereafter, the plug member can be landed on the seat causing the sleeve to move and, thus, close the ports. Alternatively, the tool can be initially configured as discussed above so that the sleeve ports and tubular member ports are initially out of alignment and are subsequently moved into alignment by landing an appropriate plug member on the seat. Further, the terms "lower end" and "upper end" are not required to be at the lowermost or uppermost points, respectively, along the length of the plug members. All that is required is that the portions of the plug members having the "upper end diameter" and "lower end diameter" are disposed one above the other along the length of the plug member. Additional components, portions, or structures, having varying diameters may be disposed above the "upper end" of the plug member, as well as below the "lower end" of the plug member. Moreover, the second seat could also include a slot for receiving the fin of the first plug member, however, the slot does not extend all the way through the second seat so that the first plug member cannot pass through the second seat. Accordingly, the invention is therefore to be limited only by the scope of the appended claims.

What is claimed is:

1. A plug member for landing on a seat disposed within a tubular member, the plug member comprising:

an upper end portion having a seat engagement profile, the seat engagement profile comprising an upper end portion diameter; and a lower end portion comprising a lower end portion diameter, wherein the seat engagement profile of the upper end portion is disposed eccentrically relative to the lower end portion and the upper end portion diameter being less than the lower end portion diameter.

2. The plug member of claim 1, further comprising at least two elements releasably attached to each other, one of the at least two elements comprising the lower end and another of the at least two elements comprising the upper end.

3. The plug member of claim 2, wherein the plug element comprises a first element, a second element, and a third element, the first element comprising the lower end, the third element comprising the upper end, and the second element being disposed between the first element and the third element, the second element comprising a second element diameter, the second element diameter being less than the lower end diameter.

4. A downhole tool for restricting flow through a bore of the downhole tool, the downhole tool comprising:

a tubular member having an inner wall surface defining a tubular bore;

a first seat disposed along the inner wall surface, the first seat having a first seat inner diameter and a first seat length;

a second seat disposed along the inner wall surface, the second seat being disposed below the first seat, the second seat having a second seat inner diameter and a second seat length, the first seat inner diameter being substantially equal to the second seat inner diameter and the second seat length being longer than the first seat length; and a first plug member, the first plug member comprising an upper end having a seat engagement profile, the upper end comprising an upper end diameter, and a lower end comprising a lower end diameter, the upper end diameter being less than the lower end diameter and the upper end being disposed eccentrically relative to the lower end, wherein, the first plug member passes through the first seat and lands on the second seat to restrict fluid flow through the bore of the tubular member.

5. The downhole tool of claim 4, wherein the second seat is disposed on a first sleeve, the first sleeve having a first sleeve port, and the tubular member comprises a first tubular member port, wherein landing of the first plug member on the second seat causes movement of the first sleeve to align the first sleeve port with the first tubular member port.

6. The downhole tool of claim 4, wherein the first seat is disposed on a first sleeve, the first sleeve having a first sleeve port, and the tubular member comprises a first tubular member port, wherein landing a second plug member on the first seat causes movement of the first sleeve to align the first sleeve port with the first tubular member port.

7. The downhole tool of claim 6, wherein the second seat is disposed on a second sleeve, the second sleeve having a second sleeve port, and the tubular member comprises a second tubular member port, wherein landing the first plug member on the second seat causes movement of the second sleeve to align the second port with the second tubular member port.

8. The downhole tool of claim 4, further comprising a second plug member, the second plug member having a second plug shape reciprocal to the first seat for landing on the first seat and restricting fluid flow through the first seat.

9. The downhole tool of claim 8, wherein the second plug member comprises an eccentric shape, the eccentric shape comprising an upper end having an upper end diameter for engaging a portion of the first seat and a lower end having a lower end diameter substantially equal to the first seat inner diameter.

10. The downhole tool of claim 4, wherein the upper end diameter of the first plug member engages with a portion of the second seat when the first plug member lands on the second seat, and wherein the lower end diameter of the first plug member engages with an inner wall surface of the second seat inner diameter when the first plug member lands on the second seat.

11. The downhole tool of claim 4, wherein the first plug element comprises a first element, a second element, and a third element, the first element comprising the lower end, the third element comprising the upper end, and the second element being disposed between the first element and the third element, the second element comprising a second element diameter, the second element diameter being less than the lower end diameter.

12. A method of restricting fluid flow through a wellbore conduit having two or more seats, each of the two or more seats comprising inner diameters substantially equal to each other, the method comprising the steps of:

(a) providing an upper seat and a lower seat disposed within a tubular member having a longitudinal bore, the upper seat having an upper seat diameter, the lower seat having a lower seat diameter, the upper seat diameter being substantially equal to the lower seat diameter;

(b) lowering the tubular member into a wellbore; and (c) restricting the longitudinal bore by inserting a first plug element into the longitudinal bore and passing the first plug element through the upper seat and landing the first plug member on the lower seat, wherein the first plug element comprises an eccentric shape allowing the first plug member to pass through the upper seat and land on the lower seat to restrict fluid flow through the second seat.

13. The method of claim 12, wherein the first plug element is passed through the upper seat by exerting a force on the first plug element facilitating passing the first plug element through the upper seat diameter.

14. The method of claim 12, wherein during step (c), a first sleeve is moved longitudinally within the tubular member to align a first sleeve port disposed within the first sleeve with a first tubular member port disposed in the tubular member.

15. The method of claim 14, further comprising the step of:

(d) inserting a second plug member into the longitudinal bore and landing the second plug member on the upper seat.

16. The method of claim 15, further comprising the step of:

(d) moving a second sleeve longitudinally within the tubular member to align a second sleeve port disposed within the second sleeve with a second tubular member port disposed in the tubular member, wherein step (d) is performed after step (c).

17. The method of claim 16, wherein the second plug element comprises an eccentric shape.

* * * * *